United States Patent [19]

Jacobson

[11] 4,240,761

[45] Dec. 23, 1980

[54] LOOSELEAF BINDER-DISPLAY STAND

[76] Inventor: Samuel O. Jacobson, 11255 Gaviota Ave., Granada Hills, Calif. 91344

[21] Appl. No.: 52,870

[22] Filed: Jun. 28, 1979

[51] Int. Cl.[3] ..... B42F 13/40

[52] U.S. Cl. ..... 402/76; 281/33; 402/72

[58] Field of Search ..... 281/15 R, 15 A, 15 B, 281/29, 33, 42; 402/70, 71, 72, 73, 74, 75, 76, 80

[56] References Cited

U.S. PATENT DOCUMENTS

| | | | |
|---|---|---|---|
| 1,577,697 | 3/1926 | Douglas | 402/73 X |
| 1,659,395 | 2/1928 | Douglas | 402/77 X |
| 2,333,523 | 11/1943 | Cohun | 402/77 X |
| 2,490,356 | 12/1949 | Hummel | 281/33 X |
| 2,550,279 | 4/1951 | Mamer | 281/33 X |
| 2,739,825 | 3/1956 | Douglas | 281/33 |
| 2,916,848 | 12/1959 | Schlachter | 281/33 |

*Primary Examiner*—Paul A. Bell

[57] ABSTRACT

A looseleaf binder-display stand comprising a plurality of hingedly connected panels with multiple fastener means attached thereto; said binder, when closed, may be carried in the manner of a satchel by a handle, said closed binder fashioned to include a panel component to separate an article folder or purse from a plurality of binder inserts attached therein; said looseleaf binder, when opened, may function as a notebook, study carrel, or bookstand; said binder reversely foldable and erectable into a display stand for insert sheets propped thereon.

12 Claims, 15 Drawing Figures

LOOSELEAF BINDER-DISPLAY STAND

My present invention relates to improvements in looseleaf binders and display stands of this general class and more particularly to the structure, arrangements, and uses herein described and claimed.

An object of the invention is to provide a loosefleaf binder-display stand which students, researchers, sales persons, and others may use for multiple applications. To this end important features of the structure include a plurality of hingedly connected panels with fasteners attached thereto so that the device may be carried in satchel-like fashion by means of a handle and, when desired, may be opened for use as a notebook or adapted to set-up positions which serve the functions of study carrel, bookstand, or insert display prop.

Another important object is to provide a looseleaf binder with a structural capability which will permit either the inner or outer panel surfaces to be used as an inclined prop for displaying books, inserts, or other articles.

Still another important object is to provide a looseleaf binder which has adaptability for use as a bookstand wherein a book's pages may either be held open by the structure or easily released for the turning thereof.

A further object is to provide a looseleaf binder which, when closed for transporting, may secure between its panels a separate article folder or purse wherein said folder or purse is separated from attached insert sheets by a separator panel component.

Still another very important object is to improve upon prior art structures so that the new structure will consolidate a plurality of prior art applications thus incorporating them into one single device and, further, that the new construction will be simpler, more versitile, and efficient in discharging its plurality of applications.

Other and further objects, features, and advantages will become apparent upon analysis of the following drawings taken in conjunction with the specification and appended claims.

Figure 1:
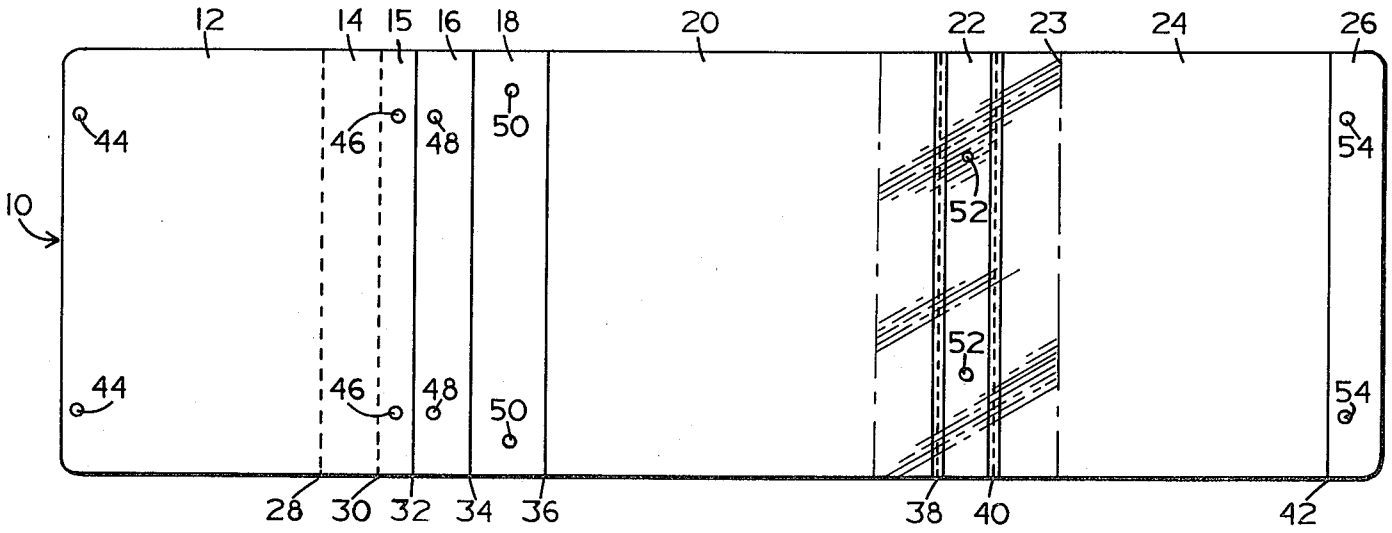
FIG. 1 is a plan view of a blank embodying the present invention.

In the drawings, like numerals refer to like elements throughout. Further, it should be noted that the elongated device is fashioned from relatively stiff sheet material comprising a plurality of hingedly connected panels which are formed either from a single blank by scoring or cut individually and attached one to the other by such means as binding and cloth tape to form the basic embodiment of the invention.

In FIG. 1, structure 10 comprises separator-bookrest panel 12, cradle-pagestop panels 14, 15, and 16, first dorsum panel 18, rear cover panel 20, second dorsum panel 22, front cover panel 24, and end panel 26. Panels 12, 14, 22, and 24 are outwardly foldable along broken lines 28, 30, 38, and 40 respectively. Panels 15, 16, 18, 20, 22, 24, and 26 are inwardly foldable along solid lines 32, 34, 36, 38, 40, and 42 respectively. Tape means 23, shown in phantom lines, are included when binder 10 is constructed by individually cut panels attached one to the other. Holes 44, 46, 48, and 54 are cut therethrough for the attachment of snap, toggle, or other type fasteners. Holes 50 are cut therethrough for the rivit attachment of a looseleaf binder mechanism. Holes 52 are cut therethrough for the rivit attachment of a handle.

Figure 2:
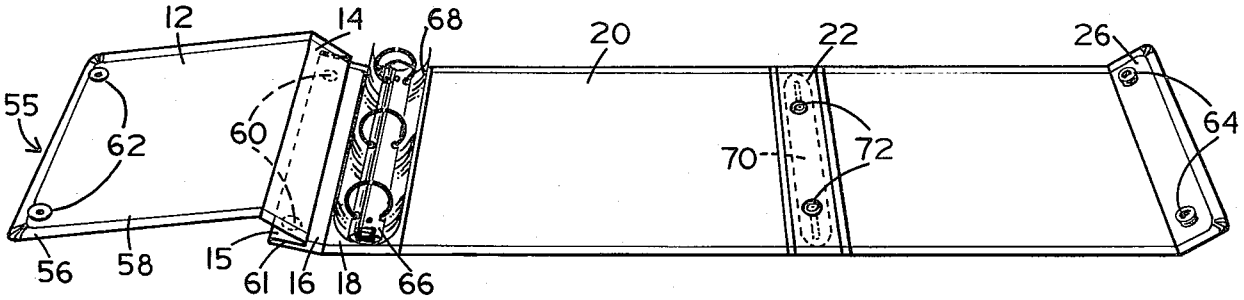
FIG. 2 is a view in perspective of a looseleaf binder-display stand assembly illustrated in a fully opened position.

In FIG. 2 there is shown a looseleaf binder-display stand assembly 55 on which a cloth, plastic, or other covering 56 has been attached to the exterior side of the device. Covering 56, after having been folded and glued around the edges of the device, is then overlapped by an interior covering 58 which is also attached thereto by glue or other such means. Panels 15 and 16 are folded inwardly so that their inner surfaces are secured in permanent tangency by fastener means 60 thus forming double thickness panel 61. Male fastener means 60 and 62 protrude on the exterior surfaces of panels 61 and 12 respectively. Female fastener means 64 protrude on the interior surface of panel 26 and are aligned so that they are ingageable with the exterior protrusions of either 60 or 62 fastener means. Binder mechanism 66 is mounted to the interior surface of panel 18 to hold binder inserts. Shim 68 is also mounted to panel 18 to prevent damage to the interior surfaces of panels 14 and 20 when binder 55 is used as a bookstand. Slotted handle strap 70 is attached to the exterior surface of panel 22 by fastener means 72.

Figure 3:
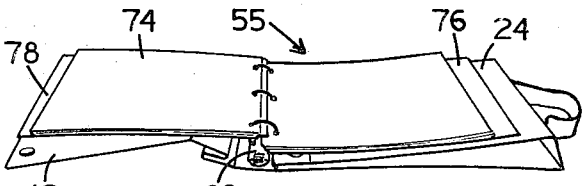
FIG. 3 is a view in perspective of a looseleaf binder-display stand with attached inserts arranged to illustrate the device in position for use as a notebook.

There is illustrated in FIG. 3 a looseleaf binder-display stand 55 set up for the application of notebook. In this position, said notebook occupies no more space on a desk or table surface than a notebook of conventional design. Since panels 12 and 24 are not well adapted as a backing for flexible looseleaf inserts 74, substantially stiff inserts 76 and 78 are attached to binder mechanism 66 to function as a smooth and stable backing for writing by hand on said flexible insert sheets 74.

Figure 4:
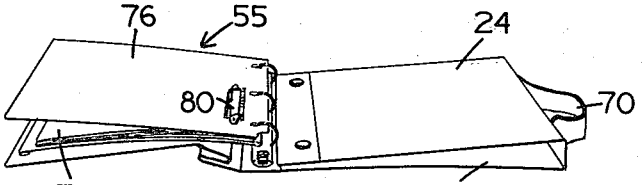
FIG. 4 is a view in perspective of a looseleaf binder-display stand containing attached inserts including a stiff panel insert which may be removed therefrom and used as a clipboard.

In FIG. 4 there is shown stiff insert 76 to which is attached a clip 80. When it becomes desirable to remove insert 76 from binder 55 for use as a clip board, then panel 20 may become an alternately smooth and stiff surface backing for writing on flexible insert sheets 74. This set-up is accomplished by straightening strap 70, as illustrated in FIG. 2, and then reversely folding panel 24 so that it lies rearward of and in substantial tangency with panel 20.

Figure 5:
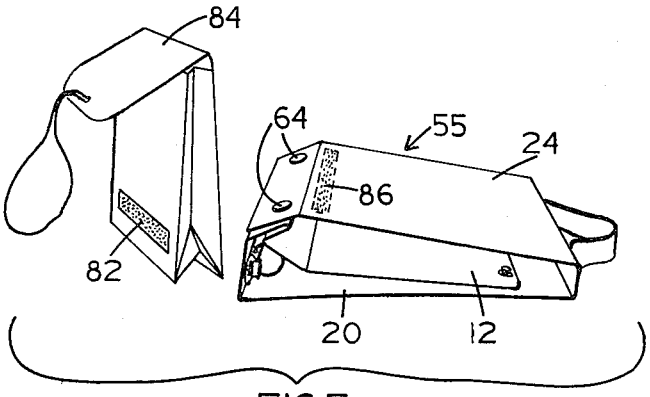
FIG. 5 is a view in perspective of a closed looseleaf binder-display stand and a separate article folder means.

In FIG. 5, device 55 is held closed by snap fastener means 64. In this closed position, panel 12 functions as a separator between panels 20 and 24. Article folder 84 may be stored between panels 12 and 24. The space between panels 12 and 20 is reserved for the attachment and storage of looseleaf binder inserts. The inward pressing of panel 12 against panel 20 when device 55 is snapped closed will cause inserts placed therebetween to be firmly held in place. A fastener 82 is attached to the smooth exterior of article folder 84. Similarly, a fastener 86 is attached to the smooth interior surface of panel 24. When article folder 84 is placed between panels 12 and 24, fasteners 82 and 86 adhere together thus preventing article folder 84 from becoming easily dislodged therefrom. Further, if article folder 84 is replaced with a hand-bag or purse made of the same rough cloth material used to cover the exterior surface of device 55, then friction will firmly hold said handbag or purse between panels 12 and 24 thus eliminating the need for fasteners 82 and 86.

Figure 6:
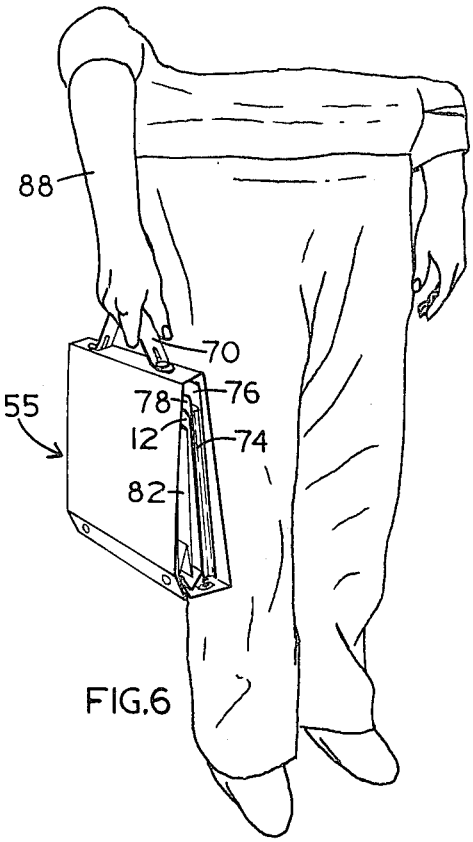
FIG. 6 is a view in perspective of one method of carrying an article folder secured within a closed looseleaf binder-display stand.

FIG. 6 illustrates one method of conveniently transporting device 55 by person 88. By means of handle strap 70, device 55 may be carried in satchel-like fashion. Inserts 74, 76, and 78 are shown to be separated from article folder 82 by panel 12.

Figure 7:
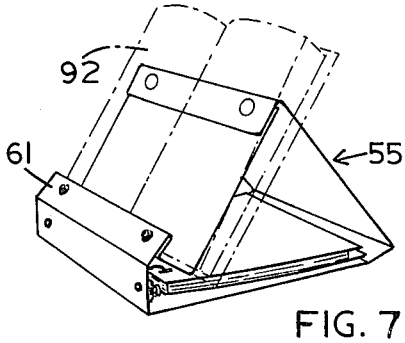
FIG. 7 is a front view in perspective of a looseleaf binder-display stand positioned for use as a bookstand.

FIG. 7 illustrates device 55 set up as a bookstand. Book 92, shown in phantom lines, is propped for easy viewing with its pages held open at their bottom edges by panel 61.

Figure 8:
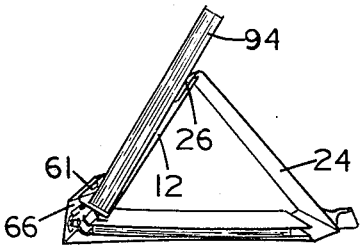
FIG. 8 is a side view in perspective of a looseleaf binder-display stand set up to prop a thin book in a rearwardly inclined position.

In FIG. 8 there is shown a thin, closed book 94 rearwardly propped by panels 12 and 24. Panel 26 is attached to panel 12 by fastener means which are not visable but illustrated in FIGS. 2 and 7. The downward pull of book 94 causes panel 61 to press inwardly against the bottom of book 94. The rings of binder mechanism 66 function as a fulcrum for this pressure.

Figure 9:
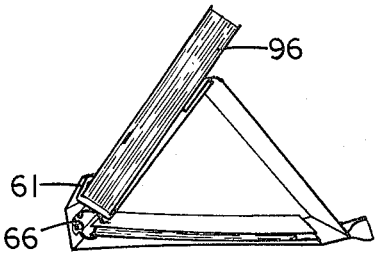
FIG. 9 is a side view in perspective of a looseleaf binder-display stand set up to prop a thick book in a rearwardly inclined position.

Book 96 of FIG. 9, being larger in thickness than book 94 of FIG. 8, forces panel 61 to open outwardly. The pull of gravity, however, is still maintained and panel 61 presses against book 96 with binder mechanism 66 acting as a fulcrum.

Figure 10:
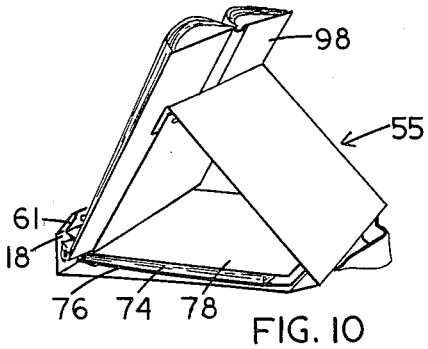
FIG. 10 is a rear view in perspective of a looseleaf binder-display stand set up to prop an opened book wherein said book's pages are held open by the pressure of a panel component pressing against said pages.

Device 55 of FIG. 10 illustrates that when panel 18 rests in vertical relationship to a desk or table surface, panel 61 will hold the pages of book 98 open without disarranging inserts 74, 76, and 78. This positioning of book 98 is desirable when reading and is especially convenient when a viewer has removed inserts 74 for note taking or copying from book 98.

Figure 11:
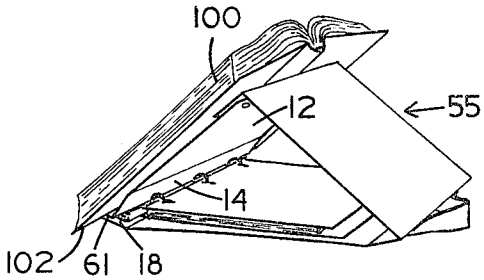
FIG. 11 is a rear view in perspective of a looseleaf binder-display stand set up to prop an opend book on panel components wherein said book's pages are positioned for the easy turning thereof.

FIG. 11, when compared with FIG. 10, illustrates device 55 set up to hold opened book 100 in a greater degree of rearward inclination wherein book 100 pages may be freely turned. Panel 18 rests in near tangency with a desk or table surface. Panel 14 becomes a nearly straight extention of panel 12 and panel 61 becomes a nearly straight extension of panel 18. The bottom edge 102 of book 100 rests contiguously on panel 61. The slight upward tilt of panels 61 and 18 from the desk's top surface prevents book 100 from slipping off device 55 while it is being read or its pages are being turned.

Figure 12:
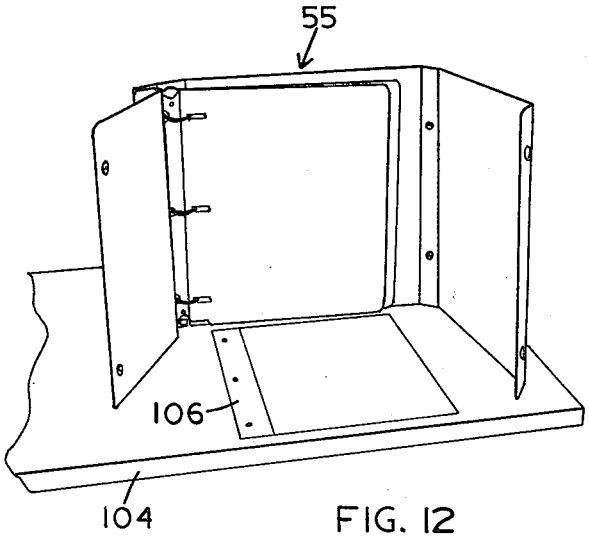
FIG. 12 is a front view in perspective of a looseleaf binder-display stand set up for the application of study carrel.

In FIG. 12, device 55 is shown in an opened and set-up position for use as a study carrel. The vertical position of device 55, which rests on table surface 104, permits a person to have relative privacy as said person writes on sheet 106.

Figure 13:
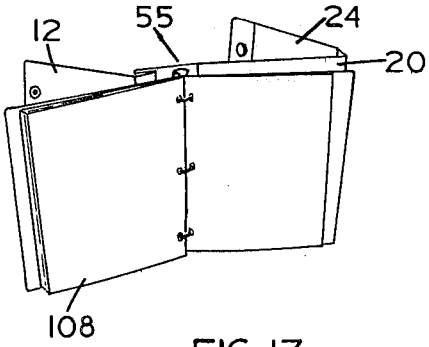
FIG. 13 is a front view in perspective of a looseleaf binder-display stand set up vertically for the purpose of displaying attached insert sheets.

In FIG. 13, device 55 is set up as a vertical prop for displaying inserts 108. This positioning is made possible by folding panels 12 and 24 outwardly and rearward of panel 20.

Figure 14:
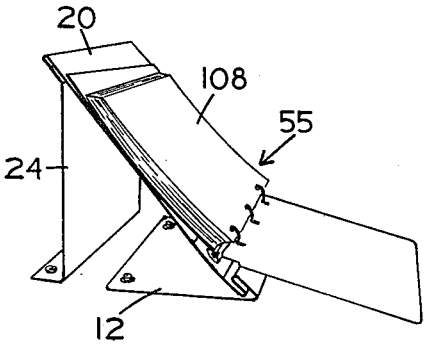
FIG. 14 is a side view in perspective of a looseleaf binder-display stand folded inside out and set up as an inclined prop for displaying thereon attached inserts sheets.

In FIG. 14, device 55 is folded inside out to be used as a display stand. Panel 12 is used as a base and panel 24 is used as a back support for panel 20. Insert sheets 108 may be displayed sideward against panel 20 in an inclined position.

Figure 15:
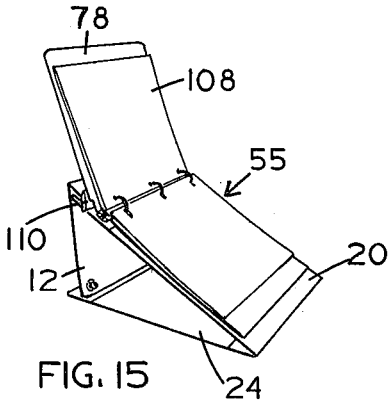
FIG. 15 is a side view in perspective of a looseleaf binder-display stand folded inside out and set up as an inclined prop for displaying thereon attached insert sheets.

In FIG. 15, device 55 is folded inside out to form an insert display stand. As apposed to the set-up of FIG. 14, panel 24 is used as a base and panel 12 is used as a back support for panel 20. Ruler 110, or similar article, may be used as a shim to hold insert 78 in a nearly vertical but rearward inclined position. By this set-up, insert sheets 108 may be displayed in a sideward position against insert 78.

It is thought to be evident that, while the preferred embodiment of this invention has been described and illustrated to accomplish all the objects and attain all the advantages enumerated in the introduction to the specification, various modifications or alterations may be undertaken by those skilled in the art without departing from the spirit of the invention or the scope of the appended claims.

I claim:

1. A looseleaf binder-display stand comprising:

(a) a separator-bookrest panel hingedly connected to (b) a cradle-pagestop panel having (1) a first panel element hingedly connected to (2) a second panel element hingedly connected to (3) a third panel element, said cradle-pagestop panel hingedly connected to (c) a first dorsum panel, said first dorsum panel hingedly connected to (d) a second dorsum panel by (e) a back cover panel, said second dorsum panel hingedly connected to (f) an end panel by (g) a front cover panel.

2. A looseleaf binder-display stand of claim 1, further comprising means for hinging said front, second dorsum, and back panels so that said front cover panel may rest in substantial tangency with either the top or bottom surfaces of said back panel.

3. A looseleaf binder-display stand of claim 1, further comprising means for locking together in tangency the inner surfaces of said second and third panel elements so that when combined with said first panel element, said cradle-pagestop and separator-bookrest panels may hold therebetween the opened pages of a rearwardly inclined book.

4. A looseleaf binder-display stand of claim 1, further comprising means for the temporary attachment of said narrow end panel to said separator-bookrest panel so that said looseleaf binder may be used to prop a book.

5. A looseleaf binder-display stand of claim 1, further comprising means for attaching a looseleaf binder mechanism to said first dorsum panel so that a plurality of inserts may be attached to said mechanism.

6. A looseleaf binder-display stand of claim 5, further comprising fulcrum means for pivoting said cradle-pagestop panel so that a book may be supported thereon with its pages either propped open for reading or releasable for turning thereof.

7. A looseleaf binder-display stand of claim 6, further comprising shim means for preventing damage to the inner surfaces of said cradle-pagestop and back panels by said fulcrum means.

8. A looseleaf binder-display stand of claim 7, further comprising insert means for attachment to said looseleaf binder mechanism so that a plurality of flexible insert sheets may either be supported for writing thereon or propped in a rearwardly inclined position for the display thereof.

9. A looseleaf binder-display stand of claim 1, further comprising means for the temporary attachment of said narrow end panel to said cradle-pagestop panel so that said looseleaf binder may be fastened in a closed position.

10. A looseleaf binder-display stand of claim 1, further comprising means for the attachment of a handle to said second dorsum panel so that said closed looseleaf binder may be carried by said handle.

11. A looseleaf binder-display stand of claim 1, further comprising means for securing an article folder or purse within said closed looseleaf binder so that when said binder is carried, said article folder or purse will not be easily dislodged therefrom.

12. A looseleaf binder-display stand for multiple applications comprising an elongated structure of relatively stiff, sheet-like material formed by connecting at least two separate blanks or by scoring one single blank along a plurality of transverse parallel lines, said structure reinforced by binding and tape means affixed thereto so as to be foldable and to hingedly connect a plurality of panels at their contiguous edges; said structure having a first panel element with at least two equally spaced holes adjacent its sides and end, said holes cut therethrough for the attachment of fastener means, said first panel element's other end connected to one end of a second narrow panel element by a bottom-side hinge, said second panel element's other end connected to one end of a third narrow panel element by a bottom-side hinge, said third panel element's other end connected to one end of a fourth narrow panel element by a top-side hinge, said third and fourth panel elements each having at least two centrally spaced holes adjacent their sides and cut therethrough, said holes contiguously aligned when the inner surfaces of said third and fourth panel elements are folded together and are tangent, said aligned holes for the permanent attachment therethrough of fastener means, said fourth panel element's other end connected to one end of a fifth narrow panel element by a top-side hinge, said fifth panel element having two centrally spaced holes adjacent its sides for the attachment therethrough of means to secure a binder mechanism means, said fifth panel element's other end connected to one end of a sixth panel element by a top-side hinge, said sixth panel element's other end connected to one end of a seventh narrow panel element by bottom and top-side hinges, said seventh panel element having at least two centrally spaced holes equidistant from its sides and cut therethrough for the attachment of handle means, said seventh panel element's other end attached to one end of an eighth panel element by bottom and top-side hinges, said eighth panel element foldable to lie in substantial tangency with either said sixth panel element's top or bottom surfaces, said eighth panel element connected at its other end to one end of a ninth narrow end-panel element, said end-panel element having at least two equally spaced holes adjacent its sides and cut therethrough for the attachment of fastener means, said end-panel element's fastener means engageable with said first panel element's fastener means or with said third and fourth panel elements' fastener means.

* * * * *